US011396840B2

(12) United States Patent
Lee et al.

(10) Patent No.: US 11,396,840 B2
(45) Date of Patent: Jul. 26, 2022

(54) ENGINE COOLING SYSTEM HAVING A COOLANT CONTROL VALVE UNIT

(71) Applicants: HYUNDAI MOTOR COMPANY, Seoul (KR); KIA MOTORS CORPORATION, Seoul (KR)

(72) Inventors: Su Ho Lee, Suwon-si (KR); Min Kyun Kim, Gunpo-si (KR); Jin Pyo Kim, Hwaseong-si (KR); Changmoon Shin, Suwon-si (KR); Min Young Kwon, Hwaseong-si (KR); Junho Lee, Suwon-si (KR); Dong Ki Park, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 256 days.

(21) Appl. No.: 15/833,038

(22) Filed: Dec. 6, 2017

(65) Prior Publication Data

US 2019/0128173 A1 May 2, 2019

(30) Foreign Application Priority Data

Oct. 26, 2017 (KR) ..... 10-2017-0140017

(51) Int. Cl.

| | |
|---|---|
| ***F01P 7/16*** | (2006.01) |
| ***F01P 3/02*** | (2006.01) |
| ***F01P 7/14*** | (2006.01) |

(52) U.S. Cl.

CPC ..... *F01P 7/165* (2013.01); *F01P 3/02* (2013.01); *F01P 2003/028* (2013.01);
(Continued)

(58) Field of Classification Search

CPC ..... F01P 2003/028; F01P 2007/146; F01P 2025/30; F01P 2025/31; F01P 2025/32;
(Continued)

(56) References Cited

U.S. PATENT DOCUMENTS

| | | | |
|---|---|---|---|
| 7,168,397 | B2 | 1/2007 | Chanfreau et al. |
| 7,984,700 | B2 | 7/2011 | Chanfreau et al. |

(Continued)

FOREIGN PATENT DOCUMENTS

| | | | |
|---|---|---|---|
| JP | 2004534177 | A | 11/2004 |
| JP | 2012102688 | A | 5/2012 |

(Continued)

*Primary Examiner* — Grant Moubry
*Assistant Examiner* — Ruben Picon-Feliciano
(74) *Attorney, Agent, or Firm* — Lempia Summerfield Katz LLC

(57) ABSTRACT

An engine cooling system has a coolant control valve unit and includes a cylinder head disposed on a cylinder block. The coolant control valve unit is configured to receive coolant from a coolant outlet side of the cylinder head to control coolant distributed to a heater and a radiator and to control coolant exhausted from the cylinder block. A control unit is configured to determine a heating priority mode according to operation conditions and to substantially open a first coolant passage corresponding to the heater by controlling the coolant control valve unit in the heating priority mode.

16 Claims, 3 Drawing Sheets

(52) U.S. Cl.
CPC ..... *F01P 2007/146* (2013.01); *F01P 2025/30* (2013.01); *F01P 2025/31* (2013.01); *F01P 2025/32* (2013.01); *F01P 2025/33* (2013.01); *F01P 2025/64* (2013.01); *F01P 2037/00* (2013.01); *F01P 2060/04* (2013.01); *F01P 2060/08* (2013.01); *F01P 2060/18* (2013.01)

(58) Field of Classification Search
CPC ..... F01P 2025/33; F01P 2025/64; F01P 2037/00; F01P 2060/04; F01P 2060/08; F01P 2060/18; F01P 3/02; F01P 7/165
See application file for complete search history.

(56) References Cited

U.S. PATENT DOCUMENTS

| | | | | |
|---|---|---|---|---|
| 10,294,852 | B2 | 5/2019 | Lee et al. | |
| 10,669,923 | B2 | 6/2020 | Kloft et al. | |
| 10,690,040 | B2 | 6/2020 | Jang et al. | |
| 2004/0173167 | A1 | 9/2004 | Chanfreau et al. | |
| 2006/0201455 | A1 | 9/2006 | Chanfreau et al. | |
| 2012/0279462 | A1* | 11/2012 | Warnery | F01P 11/16 123/41.08 |
| 2013/0160723 | A1* | 6/2013 | Miyagawa | F01P 7/16 123/41.1 |
| 2013/0213600 | A1* | 8/2013 | Saitoh | F01P 7/16 165/11.1 |
| 2016/0201548 | A1* | 7/2016 | Moscherosch | F01P 7/164 123/41.02 |
| 2017/0058753 | A1 | 3/2017 | Lee et al. | |
| 2017/0298805 | A1 | 10/2017 | Kloft et al. | |
| 2017/0321595 | A1 | 11/2017 | Jang et al. | |

FOREIGN PATENT DOCUMENTS

| | | |
|---|---|---|
| KR | 1020100117909 | 11/2010 |
| KR | 101720568 B1 | 3/2017 |
| KR | 20170024380 A | 3/2017 |
| WO | 2016045895 A1 | 3/2016 |

* cited by examiner

ENGINE COOLING SYSTEM HAVING A COOLANT CONTROL VALVE UNIT

CROSS-REFERENCE TO RELATED APPLICATION

This application claims priority to and the benefit of Korean Patent Application No. 10-2017-0140017 filed in the Korean Intellectual Property Office on Oct. 26, 2017, the entire contents of which are incorporated herein by reference.

BACKGROUND

(a) Field of the Disclosure

The present disclosure relates to an engine cooling system having a coolant control valve unit for controlling coolant passing through cooling components, reducing a warming up time in a low temperature starting condition, and improving heating performance.

(b) Description of the Related Art

An engine generates torque by combustion of a fuel and exhausts combustion gas. Particularly, engine coolant circulates through the engine to absorb heat energy, and the heat energy is released to the outside through a radiator.

If a coolant temperature of an engine is low, a viscosity of oil is increased to increase engine frictional forces, fuel efficiency is reduced, an activation time of a catalyst is increased, and the quality of exhaust gas may be deteriorated.

If the coolant temperature of the engine is excessive, knocking occurs. In order to suppress the knocking, the performance of the engine may be deteriorated by controlling ignition timing. Further, if a temperature of a lubricant is excessive, lubrication may be deteriorated.

The technology of controlling a temperature of a plurality of cooling components through one coolant control valve unit includes maintaining a high temperature of coolant in a specific region of the engine and maintaining a lower temperature of the coolant in remaining regions thereof. For example, since a cylinder head has a relatively high temperature, coolant always flows through the cylinder head. Further, a cylinder block may control flow of the coolant according to a coolant temperature.

The coolant control valve unit may improve the cooling efficiency of the entire engine and reduce fuel consumption of the engine. The coolant control valve unit may do so by controlling the coolant circulating the engine (including an oil cooler, a heater, an exhaust gas recirculation (EGR) cooler, and the like) and a radiator.

Accordingly, a coolant temperature sensor detects a coolant temperature of a preset position, sets a target coolant temperature according to operation conditions, and controls a coolant control valve unit according to the target coolant temperature.

Coolant control valve units include a rotary valve type unit and a cam type unit. The rotary valve type unit rotates a pipe type rotary valve to control an opening rate of a coolant passage, which is formed at the rotary valve. Moreover, the cam type unit has an inclined surface formed therein. The inclined surface includes a constant profile formed at one surface of a cam, and controls an opening rate of the coolant passage by rotating the cam to push a rod formed therein with a valve.

The coolant control valve unit may determine a heating mode and a fuel efficiency mode according to a coolant temperature determined by a coolant temperature sensor mounted in the engine. The coolant control valve unit may also control an opening rate of the coolant passage according to variation in the coolant temperature, may reduce a warming up time, and may improve the performance of a heater.

Meanwhile, a technology has been introduced for separating coolant passing through the cylinder head and coolant passing through the cylinder block. A flow stop technology has also been introduced to increase a temperature of the coolant passing through the cylinder block. A technology has also been studied for ensuring heating performance while reducing an engine warm-up time when a heating mode is performed upon a low temperature engine start up.

The above information disclosed in this Background section is only for enhancing the understanding of the background of the disclosure. Therefore, the Background section may contain information that does not form the prior art that is already known in this country to a person of ordinary skill in the art.

SUMMARY

The present disclosure is made in an effort to provide an engine cooling system having a coolant control valve unit with the advantages of reducing a warming up or engine warm-up time in a low temperature starting condition and improving the heating performance by controlling the coolant of a cylinder block of the engine.

An embodiment of the present disclosure provides an engine cooling system having a coolant control valve unit. The engine cooling system includes: a cylinder head disposed on a cylinder block. The coolant control valve unit is configured to receive coolant from a coolant outlet side of the cylinder head, to control coolant distributed to a heater and a radiator, and to control coolant exhausted from the cylinder block. The engine cooling system also includes a control unit configured to determine a heating priority mode according to operation conditions and to greatly or substantially open a first coolant passage corresponding to the heater by controlling the coolant control valve unit in the heating priority mode. In this condition, greatly or substantially mean that the first coolant passage is open, alone or in combination with the second and third coolant passages, to a degree sufficient to prioritize coolant flowing to the heater.

In the heating priority mode, the control unit may control the coolant control valve unit to close a second coolant passage corresponding to the radiator.

In the heating priority mode, the control unit may control the coolant control valve unit to close a third coolant passage corresponding to the cylinder block or to control an opening rate of the third coolant passage.

The heating priority mode may include a maximum heating mode and an initial heating mode.

In the maximum heating mode, the control unit may control the coolant control valve unit to control the opening rate of the third coolant passage.

In the initial heating mode, the control unit may control the coolant control valve unit to cutoff the third coolant passage The initial heating mode may be performed when a coolant temperature is less than a preset value after an engine starts.

After the initial heating mode, the maximum heating mode may be performed when a coolant temperature is equal to or greater than a preset value.

The heating priority mode may be performed when an outside temperature is less than a preset temperature and when a heating switch is turned ON.

The coolant control valve unit may include: first, second, and third valves disposed to control opening rates of the first, second, and third coolant passages, respectively; rods connected with the first, second, and third valves, respectively; a cam including one surface having a preset profile corresponding to the rods, respectively; and an actuator configured to push the rods so that the first, second, and third valves open and close the first, second, and third coolant passages by rotating the cam.

The engine cooling system may further include: a first coolant temperature sensor configured to detect coolant supplied to a coolant inlet side of the cylinder block; a second coolant temperature sensor configured to detect a temperature of coolant flowing inside the cylinder block; and a third coolant temperature sensor configured to detect a temperature of coolant exhausted from the cylinder head and the cylinder block and flowing inside the coolant control valve unit.

The operation conditions may include a coolant temperature, an outside temperature, an engine revolutions-per-minute (RPM), and/or a load or fuel injection amount.

The engine cooling system may further include a coolant pump configured to pump coolant to a coolant inlet side of the cylinder block.

In a second area of a fuel efficiency mode, except for the heating priority mode, the control unit may control the coolant control valve unit to close the first coolant passage, to close the second coolant passage, and to close the third coolant passage.

In a third area of a fuel efficiency mode, except for the heating priority mode, the control unit may control the coolant control valve unit to control an opening rate of the first coolant passage, to close the second coolant passage, and to close the third coolant passage.

In a fourth area of a fuel efficiency mode, except for the heating priority mode, the control unit may control the coolant control valve unit to control an opening rate of the first coolant passage, to close the second coolant passage or control an opening of the second coolant passage, and to close the third coolant passage.

In a fifth area of a fuel efficiency mode, except for the heating priority mode, the control unit may control the coolant control valve unit to control an opening rate of the first coolant passage, to control an opening rate of the second coolant passage, and to control an opening rate of the third coolant passage.

The heating priority mode may further include a seventh area. In the seventh area, the control unit may control the coolant control valve unit to control an opening rate of the first coolant passage, to control an opening rate of the second coolant passage, and to control an opening rate of the third coolant passage to have a maximum value.

According to an embodiment of the present disclosure, the heating performance may be improved by maximizing an opening rate of a coolant passage corresponding to a heater in a heating priority mode and according to operation conditions.

Further, the heating performance may be improved and the warming up time may be reduced by closing a coolant passage corresponding to a radiator in the heating priority mode.

Moreover, the warming up time may be reduced and the heating performance may be improved by closing a coolant passage corresponding to a cylinder and an opening rate of the coolant passage in the heating priority mode.

In addition, the heating performance may be improved and the warming up time may be reduced by controlling coolant passing through the heater, the radiator, and the cylinder in a low outside temperature condition.

Figure 1:
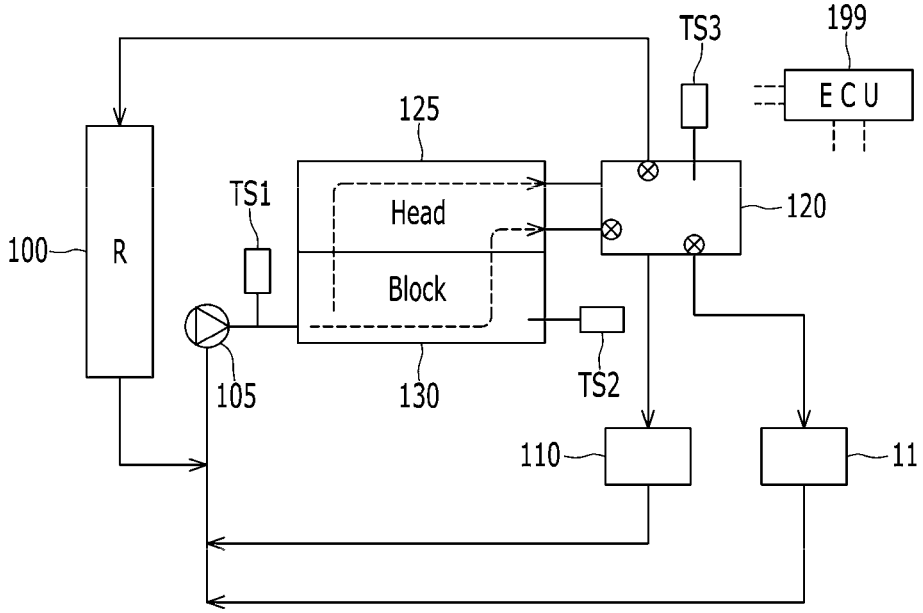
FIG. 1 is a block diagram illustrating a coolant flow paths in an engine cooling system having a coolant control valve unit according to the present disclosure.

The following symbols and corresponding descriptions are used throughout the drawings and the detailed description.

| | |
|---|---|
| 100: radiator | 105: coolant pump |
| 110: oil cooler | 115: heater |
| 120: coolant control valve unit | 125: cylinder head |
| 130: cylinder block | 199: control unit |
| 300: cam | 302: press surface |
| 305: motor | 310: gear box |
| 322a: first rod | 322b: second rod |
| 322c: third rod | 320a: first valve |
| 320b: second valve | 320c: third valve |
| 324: elastic member | 326: supporting member |
| TS1: first coolant temperature sensor | |
| TS2: second coolant temperature sensor | |
| TS3: third coolant temperature sensor | |

DETAILED DESCRIPTION OF THE EMBODIMENTS

Hereinafter, an embodiment of the present disclosure will be described in detail with reference to the accompanying drawings.

The size and thickness of each configuration shown in the drawings are optionally illustrated for better understanding and ease of description. The present disclosure is not limited to drawings presented herein. In the drawings, the thickness of layers, films, panels, regions, and the like may not be shown to scale and may be exaggerated for clarity.

Accordingly, the drawings and description are to be regarded as illustrative in nature and not restrictive. Like reference numerals designate like elements throughout the specification and drawings.

It will be understood that, although the terms 'first' and 'second' and the like may be used herein to describe various elements, the order or arrangement of these elements should not be limited by these terms. These terms are used to distinguish one element from another.

FIG. 1 is a block diagram illustrating the entire coolant flow path in an engine cooling system having a coolant control valve unit according to the present disclosure.

Referring to FIG. 1, the engine cooling system includes a radiator 100, a coolant pump 105, an oil cooler 110, a heater 115, a coolant control valve unit 120, a cylinder head 125, a cylinder block 130, a first coolant temperature sensor TS1, a second coolant temperature sensor TS2, a third coolant temperature sensor TS3, and a control unit 199.

The cylinder head 125 is disposed on the cylinder block 130 and a coolant chamber is formed inside the cylinder head 125 and the cylinder block 130. Further, a coolant inlet is formed at one side of the cylinder block 130 and a coolant outlet is formed at one side of the cylinder head 125.

The coolant control valve unit 120 is mounted at an opposite side of the cylinder head 125. The coolant control valve unit 120 may receive coolant passing through the cylinder head 125 and the cylinder block 130.

The coolant control valve unit 120 distributes the coolant received from the cylinder head 125 and the cylinder block 130 to the radiator 100, the oil cooler 110, and the heater 115.

In this case, the coolant control valve unit 120 may control coolant exhausted from the cylinder block 130 and may control the coolant distributed to the radiator 100, the oil cooler 110 and the heater 115, respectively.

The coolant pump 105 pumps the coolant to the coolant inlet side of the cylinder block 130. The coolant pumped to the cylinder block 130 flows through an inside of the cylinder head 125 and the cylinder block 130 and is collected in the coolant control valve unit 120.

The first coolant temperature sensor TS1 detects a temperature of coolant pumped from the coolant pump 105 and introduced into the cylinder block 130. The second coolant temperature sensor TS2 detects a temperature of the coolant in the cylinder block 130. The third coolant temperature sensor TS3 detects a temperature of the coolant in the coolant control valve unit 120.

In an embodiment of the present disclosure, the coolant control valve unit 120 may control an opening rate of the first coolant passage that supplies coolant to the heater 115, may control an opening rate of a second coolant passage that supplies the coolant to the radiator 100, and may control an opening rate of a third coolant passage that receives the coolant from the cylinder block 130.

Further, the coolant control valve unit 120 may always supply the coolant to the oil cooler 110 and may always receive the coolant from the cylinder head 125.

The control unit 199 may detects operation conditions and control the coolant control valve unit 120 according to the detected operation conditions to control coolant flowing through the cylinder block 130, the heater 115 and the radiator 100. For these purposes, the control unit 199 may be implemented by or include at least one processor operating by a preset program. The preset program may include a series of commands to perform a method according to an embodiment of the present disclosure.

Figure 2:
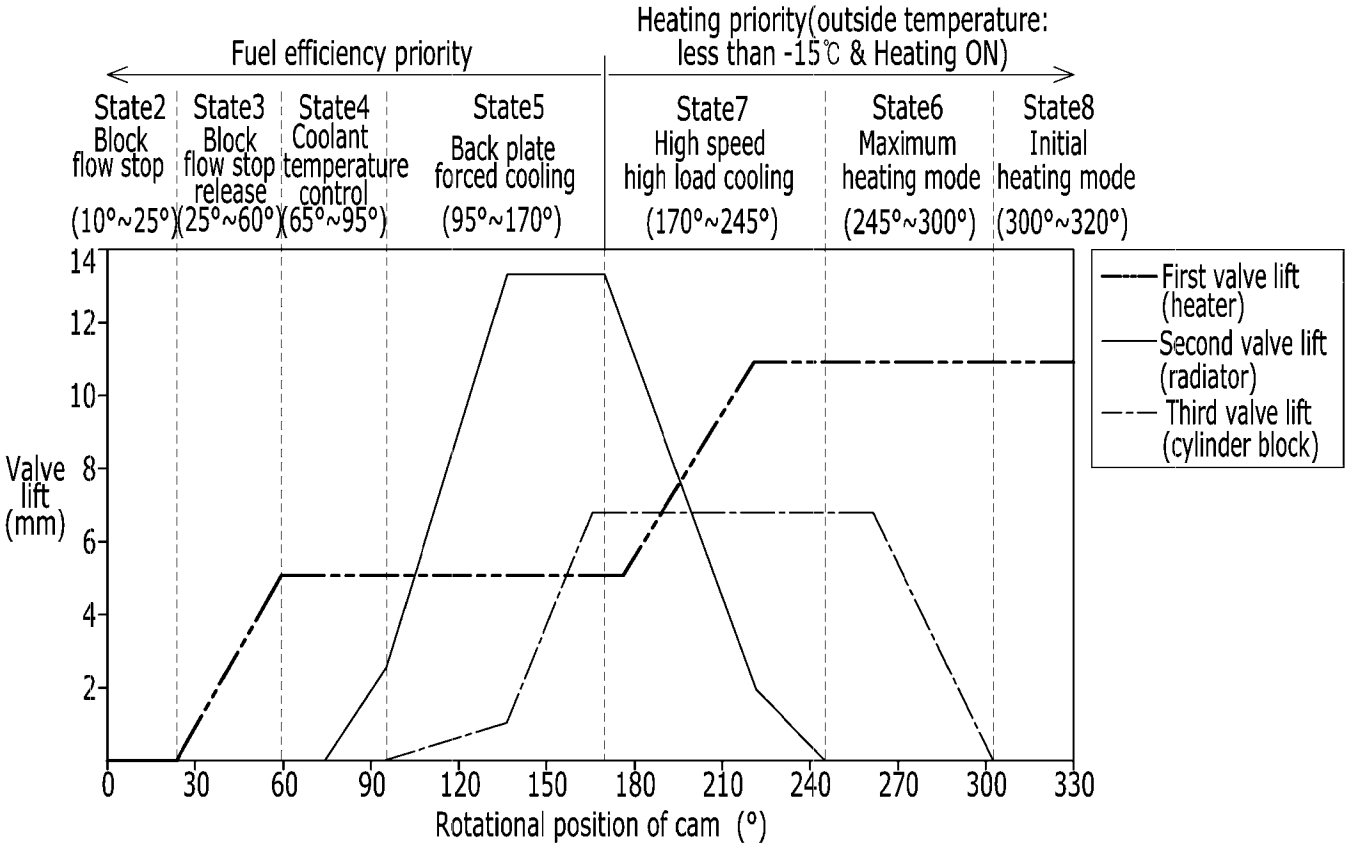
FIG. 2 is a graph illustrating valve lift according to a rotational position of a cam of a coolant control valve unit according to an embodiment of the present disclosure.

FIG. 2 is a graph illustrating valve lift according to a rotational position of a cam of a coolant control valve unit according to an embodiment of the present disclosure.

Figure 3:
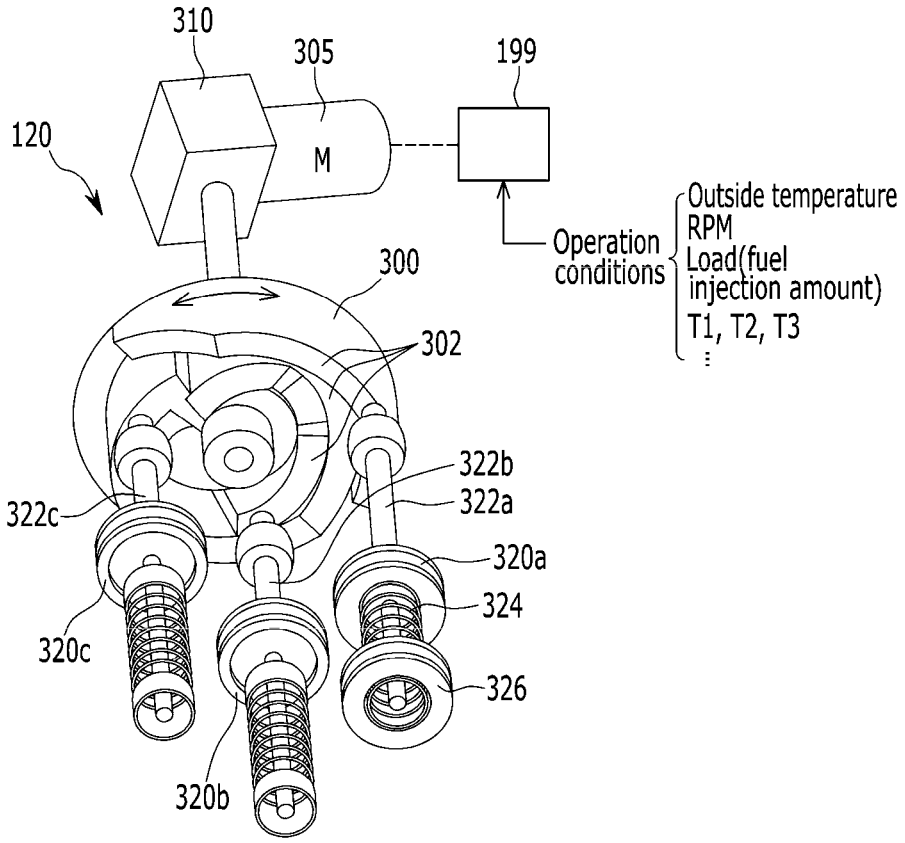
FIG. 3 is a partial perspective view illustrating a coolant control valve unit according to an embodiment of the present disclosure.

Referring to FIG. 2, a horizontal axis represents a rotational position of a cam 300 of the coolant control valve unit 120 depicted in FIG. 3 and a vertical axis represents a lift of a valve. In this case, the valve lift may be understood as a valid cross-section or may be understood as an opening rate of a valve.

It will be apparent to one of ordinary skill in the art from the present disclosure that a valid cross-section of the coolant passage is increased and an opening rate of the valve is increased if the valve lift becomes high.

A first valve 320*a* of FIG. 3 opens and closes a first coolant passage to supply the coolant to the heater 115. The highest part of a lift of the first valve 320*a* may be an opening rate of 100%.

Moreover, a second valve 320*b* of FIG. 3 opens and closes a second coolant passage to supply the coolant to the radiator 100. The highest part of a lift of the second valve 320*b* may be an opening rate of 100%.

In addition, a third valve 320*c* of FIG. 3 opens and closes a third coolant passage to supply the coolant to the cylinder block 130. The highest part of a lift of the third valve 320*b* may be an opening rate of 100%.

An operation mode is classified into a fuel efficiency priority mode and a heating priority mode. In the heating priority mode, an outside temperature is less than −15° C. (5° F.), and the heating priority mode may be performed when a heating switch is turned ON. The fuel efficiency priority mode may be determined or implement unless the system is in the heating priority mode.

The fuel efficiency priority mode may be divided into second, third, fourth, and fifth states (states 2, 3, 4, 5), the heating priority mode may be divided into seventh, sixth, and eighth states (states 7, 6, 8).

A second area (state 2) is an area where a rotation area of the cam 300 of FIG. 3 has an angle of 10° to 25°. Also, first, second, and third coolant passages corresponding to the heater 115, the radiator 100, and the cylinder block 130 are closed. In this case, the coolant flows through the oil cooler 110.

A third area (state 3) is an area where a rotation area of the cam 300 of FIG. 3 has an angle of 25° to 60°, second and third coolant passages corresponding to the radiator 100 and the cylinder block 130 are closed, and a first coolant passage corresponding to the heater 115 finely controls an opening rate to operate the heater 115.

A fourth area (state 4) is an area where a rotation area of the cam 300 of FIG. 3 has an angle of 65° to 95°. According to the coolant temperature, the second and third coolant passages corresponding to the radiator 100 and the cylinder block 130 are closed or an opening rate of the second and third coolant passages is controlled. The first coolant passage corresponding to the heater 115 maintains the opening rate in a constant state to operate the heater.

A fifth area (state 5) is an area where a rotation area of the cam 300 of FIG. 3 has an angle of 95° to 170°. According to the coolant temperature, an opening rate of the first, second, and third coolant passages corresponding to the heater 115, the radiator 100 and the cylinder block 130 is controlled.

In the fifth area (state 5), overheating of coolant may be prevented by maximizing an opening rate of a second coolant passage corresponding to the radiator 100 and maximizing an opening rate of a third coolant passage corresponding to the cylinder block 130 according to coolant temperature.

A seventh area (state 7) is an area where a rotation area of the cam 300 of FIG. 3 has an angle of 170° to 245°. According to the coolant temperature, an opening rate of the first, second, and third coolant passages corresponding to the heater 115, the radiator 100 and the cylinder block 130 is controlled.

In the seventh area (state 7), an opening rate of the third coolant passage corresponding to the cylinder block 130 may be maximized. According to the coolant temperature, an opening rate of the first coolant passage corresponding to the heater 115 may be maximized.

A sixth area (state 6) is an area where a rotation area of the cam 300 of FIG. 3 has an angle of 245° to 300°. An opening rate of the first coolant passage corresponding to the heater 115 may be maximized. An opening rate of the second coolant passage corresponding to the radiator 100 may be controlled as 0. An opening rate of the third coolant passage corresponding to the cylinder block 130 may be controlled.

In this case, the sixth area (state 6) is in a maximum heating mode. A flow rate of coolant of the radiator 100 may be controlled as minimum 0. A flow rate of coolant of the heater 115 may be controlled as a maximum value. According to the coolant temperature, the coolant of the cylinder block 130 may be controlled between a maximum value and a minimum value.

An eighth area (state 8) is an area where a rotation area of the cam 300 of FIG. 3 has an angle of 300° to 320°. An opening rate of the first coolant passage corresponding to the heater 115 may be maximized. An opening rate of the second coolant passage corresponding to the radiator 100 may be controlled as 0. An opening rate of the third coolant passage corresponding to the cylinder block 130 may be controlled as 0.

In this case, the eighth area (state 8) is in an initial heating mode. A flow rate of coolant of the radiator 100 and the cylinder block 130 may be controlled as minimum 0. A flow rate of coolant of the heater 115 may be controlled as a maximum value.

In an embodiment of the present disclosure, the maximum heating mode and the initial heating mode (sixth, eighth areas) may each refer to a heating priority mode.

FIG. 3 is a partial perspective view illustrating a coolant control valve unit according to an embodiment of the present disclosure.

Referring to FIG. 3, the coolant control valve unit 120 includes a motor 305, a gear box 310, the cam 300, a press surface 302, first, the second, and third rods 322*a*, 322*b*, and 322*c*, the first, second, and third valves 320*a*, 320*b*, and 320*c*, an elastic member 324, and a supporting member 326.

The control unit 199 may detect operation conditions (outside temperature, engine RPM, load (i.e., fuel injection amount), T1, T2, T3). The control unit 199 may also control power applied to the motor 305 to control a rotational position of the cam 300 through the gear box 310. In this case, T1, T2 and T3 are first, second, and third coolant temperatures, and may be detected by the first, second, and third coolant temperature sensors TS1, TS2, and TS3, respectively.

A drive axle (reference numeral is not shown) is connected with a center of a top surface of the cam 300, and receives a torque from the gear box 310. A press surface 302 is formed in a rotation direction based on a rotation center in a bottom surface of the cam 300. In this case, the press surface 302 is formed in three rows.

The first, second, and third rods 322*a*, 322*b*, and 322*c* are disposed in the press surface 320. The press surface 302 is formed to push the first, second, and third rods 322*a*, 322*b*, and 322*c* downward. In this case, the press surface 302 includes a profile of a slope configured in a rotating direction of the cam 300.

The first, second, and third valves 320*a*, 320*b*, and 320*c* are formed at the first, second, and third rods 322*a*, 322*b*, and 322*c*, respectively. The first, second, and third valves 320*a*, 320*b*, and 320*c* are supported upward by an elastic member 324. The elastic member 324 is supported by a supporting member 326.

In an embodiment of the present disclosure, the control unit 199 rotates the cam 300 through the motor 305 and the gear box 310. According to a rotational position of the cam 300, the press surface 302 of the cam 300 moves the first, second, and third rods 322*a*, 322*b*, and 322*c*, respectively. Thus, the first, second, and third valves 320*a*, 320*b*, and 320*c* may change an opening rate of the first, second, and third coolant passages.

A valve lift illustrated in FIG. 2 represents a moving distance of the first, second, and third valves 320*a*, 320*b*, and 320*c*. The valve lift has a minimum value 0 and a maximum value (e.g., 7, 11, 13 mm or the like).

Furthermore, if the opening rate is 0%, the valve lift may have a minimum value. If the opening rate is 100%, the valve lift may have a maximum value.

In an embodiment of the present disclosure, although the above embodiment is described as a cam type coolant control valve unit 120 as illustrated in FIG. 3, a rotary valve type coolant control valve unit is also applicable. All coolant control valve units capable of controlling an opening rate of a plurality of coolant passages are applicable.

While this disclosure has been described in connection with what are presently considered to be practical embodiments, it is to be understood that the disclosure is not limited to the disclosed embodiments. On the contrary, the disclosure is intended to cover various modifications and equivalent arrangements included within the spirit and scope of the appended claims.

What is claimed is:

1. An engine cooling system comprising:

a cylinder block having one side for receiving a coolant, the coolant in the cylinder block flowing from the one side to an opposite side;

a cylinder head disposed on the cylinder block and having one side and an opposite side for discharging coolant, the coolant in the cylinder head flowing toward the opposite side;

a coolant pump configured to supply the coolant only to the one side of the cylinder block:

a coolant control valve unit configured to continuously receive the coolant from the opposite side of the cylinder head and to supply the coolant to an oil cooler, a heater, and a radiator; and a control unit configured to determine a heating priority mode according to operation conditions, wherein the cylinder head receives the coolant only through the cylinder block, wherein the coolant circulated through the cylinder head is discharged from the opposite side of the cylinder head to the coolant control valve unit and the coolant circulated through the cylinder block is flowed into the cylinder head and is then discharged from the opposite side of the cylinder head to the coolant control valve unit, wherein the coolant control valve unit continuously receives the coolant circulated through the cylinder head, continuously supplies the coolant to the oil cooler, selectively supplies the coolant to the heater through a first coolant passage, selectively supplies the coolant to the radiator through a second coolant passage, and selectively receives the coolant passing the cylinder block through a third coolant passage, and wherein the control unit controls the coolant control valve unit to fully open the first coolant passage for the heater, to close the second coolant passage for the radiator, and to close the third coolant passage for the cylinder block or to control an opening rate of the third coolant passage in the heating priority mode.

2. The engine cooling system of claim 1, wherein the heating priority mode comprises a maximum heating mode and an initial heating mode.

3. The engine cooling system of claim 2, wherein, in the maximum heating mode, the control unit controls the coolant control valve unit to control the opening rate of the third coolant passage.

4. The engine cooling system of claim 2, wherein, in the initial heating mode, the control unit controls the coolant control valve unit to cutoff the third coolant passage.

5. The engine cooling system of claim 2, wherein the initial heating mode is performed when a coolant temperature is less than a preset value after an engine starts.

6. The engine cooling system of claim 2, wherein, after the initial heating mode, the maximum heating mode is performed when a coolant temperature is equal to or greater than a preset value.

7. The engine cooling system of claim 1, wherein the heating priority mode is performed when an outside temperature is less than a preset temperature and when a heating switch is turned ON.

8. The engine cooling system of claim 1, wherein the coolant control valve unit comprises:

first, second, and third valves disposed to control opening rates of the first, second, and third coolant passages, respectively;

rods connected with the first, second, and third valves, respectively;

a cam including one surface having a preset profile corresponding to the rods, respectively; and an actuator configured to push the rods so that the first, second, and third valves open or close the first, second, and third coolant passages by rotating the cam.

9. The engine cooling system of claim 1, further comprising:

a first coolant temperature sensor configured to detect the coolant supplied to the one side of the cylinder block;

a second coolant temperature sensor configured to detect a temperature of the coolant flowing inside the cylinder block; and a third coolant temperature sensor configured to detect a temperature of the coolant discharged from the cylinder head and the cylinder block and flowing inside the coolant control valve unit.

10. The engine cooling system of claim 1, wherein the operation conditions comprise a coolant temperature, an outside temperature, an engine revolutions-per-minute (RPM), or a load or fuel injection amount.

11. The engine cooling system of claim 1, wherein the operation conditions comprise a coolant temperature, an outside temperature, an engine revolutions-per-minute (RPM), and a load or fuel injection amount.

12. The engine cooling system of claim 1, wherein, in a second area of a fuel efficiency mode, except for the heating priority mode, the control unit controls the coolant control valve unit to close the first coolant passage, to close the second coolant passage, and to close the third coolant passage.

13. The engine cooling system of claim 1, wherein, in a third area of a fuel efficiency mode, except for the heating priority mode, the control unit controls the coolant control valve unit to control an opening rate of the first coolant passage, to close the second coolant passage, and to close the third coolant passage.

14. The engine cooling system of claim 1, wherein, in a fourth area of a fuel efficiency mode, except for the heating priority mode, the control unit controls the coolant control valve unit to control an opening rate of the first coolant passage, to close the second coolant passage or control an opening of the second coolant passage, and to close the third coolant passage.

15. The engine cooling system of claim 1, wherein, in a fifth area of a fuel efficiency mode, except for the heating priority mode, the control unit controls the coolant control valve unit to control an opening rate of the first coolant passage, to control an opening rate of the second coolant passage, and to control an opening rate of the third coolant passage.

16. The engine cooling system of claim 1, wherein, the heating priority mode further comprises a seventh area, and wherein, in the seventh area, the control unit controls the coolant control valve unit to control an opening rate of the first coolant passage, to control an opening rate of the second coolant passage, and to control an opening rate of the third coolant passage to have a maximum value.

* * * * *